US009863277B2

(12) United States Patent
Lefebvre et al.

(10) Patent No.: US 9,863,277 B2
(45) Date of Patent: Jan. 9, 2018

(54) FAN ROTOR, IN PARTICULAR FOR A TURBINE ENGINE

(71) Applicant: SNECMA, Paris (FR)

(72) Inventors: Olivier Lefebvre, Melun (FR); Marc Jolly, Alfortville (FR)

(73) Assignee: SNECMA, Paris (FR)

( * ) Notice: Subject to any disclaimer, the term of this patent is extended or adjusted under 35 U.S.C. 154(b) by 377 days.

(21) Appl. No.: 14/425,927

(22) PCT Filed: Aug. 29, 2013

(86) PCT No.: PCT/FR2013/051993
§ 371 (c)(1),
(2) Date: Mar. 4, 2015

(87) PCT Pub. No.: WO2014/037653
PCT Pub. Date: Mar. 13, 2014

(65) Prior Publication Data

US 2015/0226087 A1 Aug. 13, 2015

(30) Foreign Application Priority Data

Sep. 5, 2012 (FR) ..... 12 58307

(51) Int. Cl.
*F01D 25/24* (2006.01)
*F01D 25/16* (2006.01)
(Continued)

(52) U.S. Cl.
CPC ..... *F01D 25/243* (2013.01); *F01D 1/20* (2013.01); *F01D 5/3007* (2013.01);
(Continued)

(58) Field of Classification Search
CPC .... F01D 5/3015; F01D 5/3069; F01D 25/243; F04D 29/321; F04D 29/322; F05D 2220/36
See application file for complete search history.

(56) References Cited

U.S. PATENT DOCUMENTS

2003/0194318 A1 10/2003 Duesler et al.
2009/0269202 A1 10/2009 Borzakian et al.

FOREIGN PATENT DOCUMENTS

EP 1 357 254 10/2003
FR 2 971 822 8/2012
GB 2 459 366 10/2009

OTHER PUBLICATIONS

International Search Report dated Nov. 11, 2013 in PCT/FR13/051993 Filed Aug. 29, 2013.

*Primary Examiner* — Nathaniel Wiehe
*Assistant Examiner* — Brian O Peters
(74) *Attorney, Agent, or Firm* — Oblon, McClelland, Maier & Neustadt, L.L.P.

(57) ABSTRACT

A turbine engine fan rotor having a disk carrying blades, a substantially frustoconical cover mounted on the disk, and axial retention device for retaining the blades and including a ring mounted in an annular groove in the disk and forming a bearing surface for roots of the blades. The ring is festooned or crenellated and co-operates with a festooned radial annular lip of the disk. The rotor also has at least one axial tooth inserted in hollow portions of the ring and of the lip of the disk. Two coaxial parts arranged radially inside the disk have respective first and second fastener flanges for fastening to the disk, said flanges being axially interposed between the cover and the disk, being circumferentially offset relative to one another, and being fastened independently of one another to the disk.

8 Claims, 6 Drawing Sheets

(51) Int. Cl.

| | |
|---|---|
| ***F01D 5/30*** | (2006.01) |
| ***F04D 29/32*** | (2006.01) |
| ***F01D 1/20*** | (2006.01) |
| ***F01D 21/00*** | (2006.01) |

(52) U.S. Cl.
CPC ..... *F01D 5/3015* (2013.01); *F01D 21/003* (2013.01); *F01D 25/162* (2013.01); *F05D 2220/36* (2013.01)

FAN ROTOR, IN PARTICULAR FOR A TURBINE ENGINE

The present invention relates to a fan rotor, in particular for a turbine engine such as an airplane turboprop or turbojet.

A fan rotor is described in patent application FR 11/51401 in the name of the Applicant, and comprises a disk carrying blades having their roots engaged in substantially axial slots in the outer periphery of the disk, a substantially frustoconical cover mounted on the disk upstream from the blades, and axial retention means for axially retaining the blades on the disk and comprising a ring mounted in an annular groove in the disk and forming a bearing surface for the roots of the blades. The ring is festooned or crenellated and co-operates with a festooned radial annular lip of the disk. Means are also provided for preventing the ring from moving in rotation, which means comprise a band carrying axial teeth inserted in hollow portions of the ring and of the lip of the disk, the band being fastened by bolts to the disk.

Studies on the dynamic behavior of the turbine engine have led to a need to mount various parts of a telemeter within the rotor, and in particular inside the disk. The measurements taken with the help of the telemeter are constituted in particular by stress measurements or by temperature measurements of the disk or of the blades of the fan.

At least two of these parts need to be capable of being fastened in simple and reliable manner to the rotor, which is impossible with the present rotor structure, given the small amount of space available therein.

A particular object of the present invention is to provide a solution to this problem that is simple, effective, and inexpensive.

For this purpose, the invention proposes a fan rotor, in particular for a turbine engine, the rotor comprising a disk carrying blades having roots engaged in substantially axial slots in the outer periphery of the disk, a substantially frustoconical cover mounted on the disk upstream from the blades, and axial retention means for retaining the blades on the disk, which means comprise a ring mounted in an annular groove in the disk and forming a bearing surface for the roots of the blades, the ring being festooned or crenellated and co-operating with a festooned radial annular lip of the annular groove in the disk, and means for preventing the ring from moving in rotation, which means comprise at least one axial tooth engaged in hollow portions of the ring and of the lip of the disk, the rotor being characterized in that it further includes at least first and second coaxial parts arranged radially inside the disk and having respective first and second fastener flanges for fastening to the disk, said flanges being axially interposed between the cover and the disk, being circumferentially offset relative to one another, and being fastened independently of one another to the disk.

The circumferential offset between the first and second flanges enables each of the first and second parts to be fastened to the disk, in little axial space.

Preferably, the axial teeth are formed in the cover.

There is thus no longer any need to provide a band carrying the teeth, as in the prior art, such that the space occupied by the flange of the band can be used for the flanges of the first and second parts that are to be incorporated.

According to a characteristic of the invention, the first part has a plurality of first flanges that are circumferentially offset from one another and situated in a common radial plane, and the second part has a plurality of second flanges that are circumferentially offset from one another and situated in the same radial plane as the first flanges, each second flange being circumferentially interposed between two first flanges.

Furthermore, the first part may be situated radially inside the second part, the second part including at least one notch having a flange of the first part passing radially therethrough.

Also, the cover may include holes for fastening it to the disk by means of bolts mounted in said holes in the cover and also passing through the flanges of only one of the first and second parts, the flanges of the other one of said parts being fastened to the disk by means of other bolts.

Advantageously, the first and second flanges may be formed by lugs extending radially outwards from the first and second parts.

As mentioned above, the first and second parts may belong to a telemetry system.

The invention also provides a turbine engine, characterized in that it includes a rotor of the above-specified type.

The invention can be better understood and other details, characteristics, and advantages of the invention appear on reading the following description made by way of non-limiting example and with reference to the accompanying drawings, in which.

Figure 1:
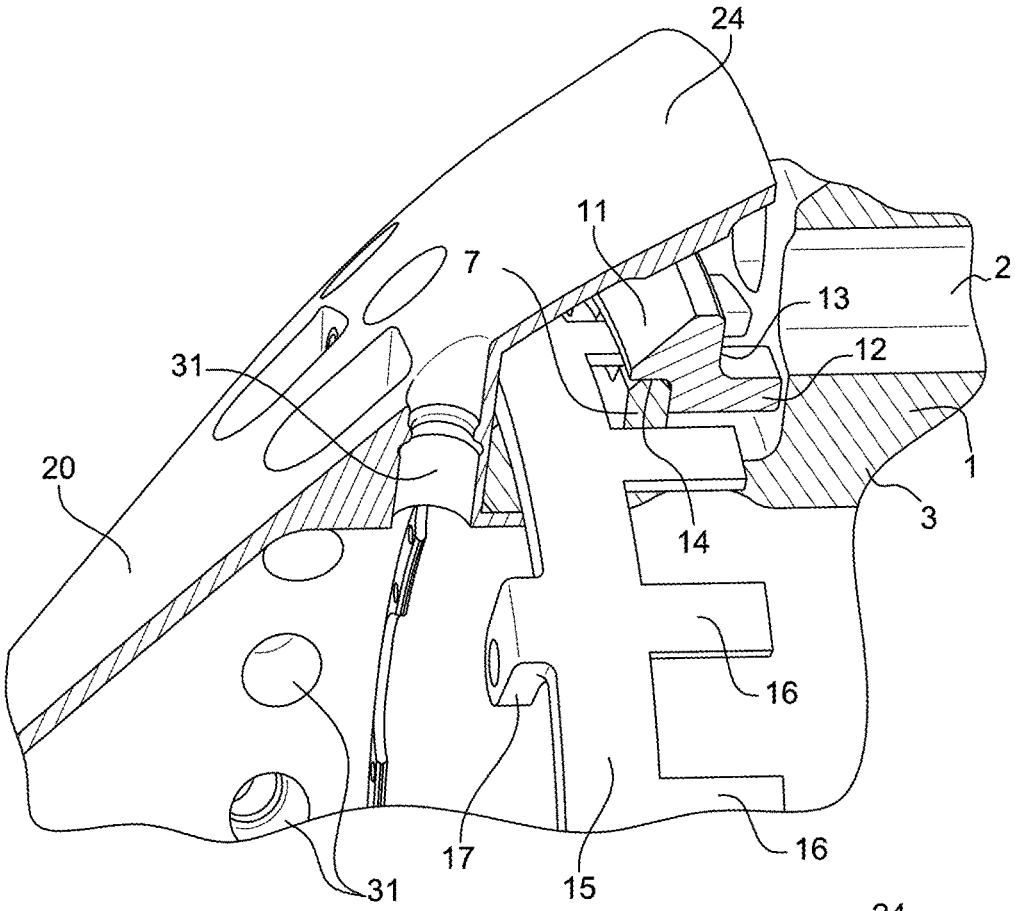
Fig. 1 PRIOR ART
FIGS. 1 and 2 are perspective views of a portion of the prior art fan rotor.
Figure 2:
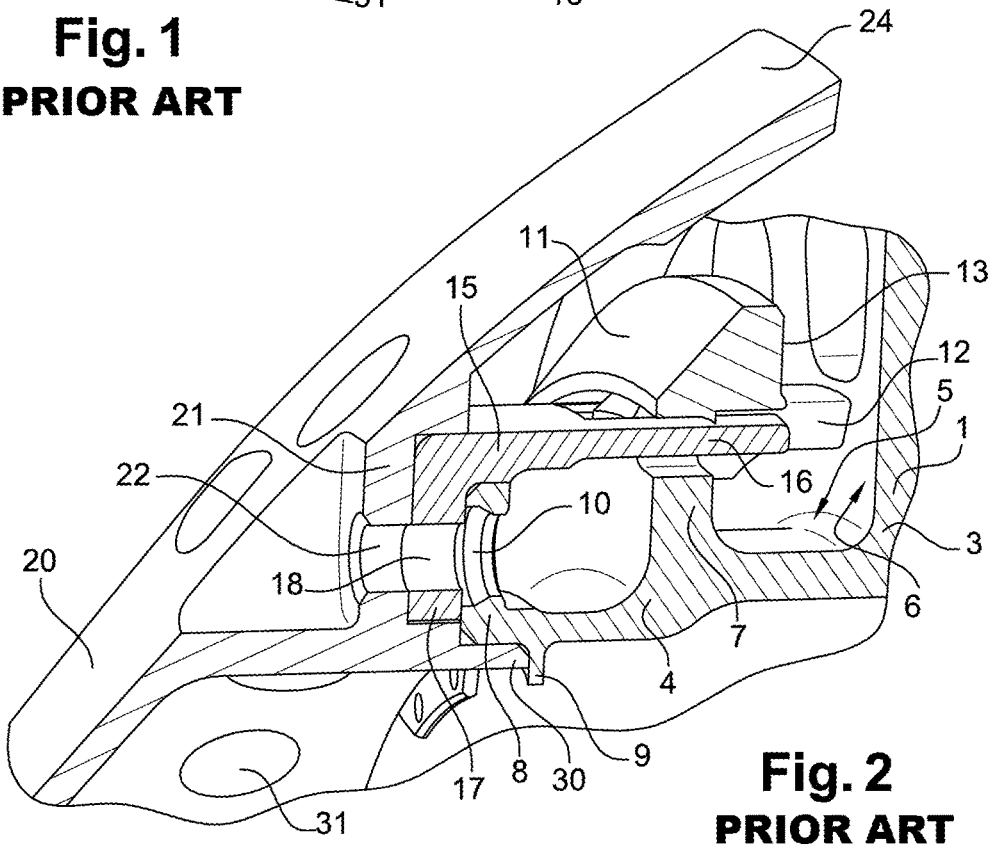
Fig. 2 PRIOR ART
Figure 3:
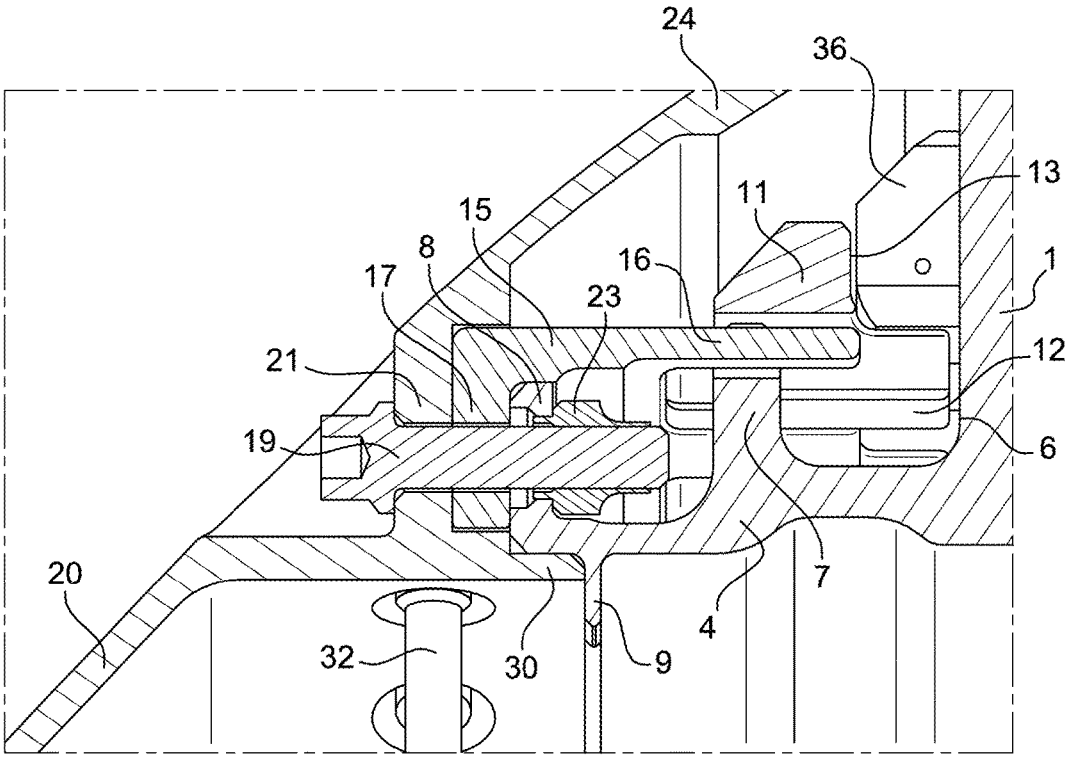
Fig. 3 PRIOR ART
FIG. 3 is a section view of a portion of the prior art fan rotor, showing a bolt for fastening the cover to the disk.

Reference is made initially to FIGS. 1 to 6, which show a prior art fan rotor as described in patent application FR 11/51401 in the name of the Applicant. It comprises a disk 1 carrying blades having roots (not shown) that are engaged in substantially axial recesses or slots 2 in the outer periphery of the disk 1, spacers 36 (FIGS. 3 to 4) being mounted between the roots of the blades and the bottoms of the slots 2.

The disk 1 has an annular rim 3 without any balance weights that is extended upstream by an annular portion 4 having an annular groove 5 defined between an upstream face 6 of the rim 3 and an outwardly-directed radial lip 7. The upstream end of the annular portion 4 has a flange 8 extending radially outwards and spaced apart from the lip 7, with radially inwardly extending abutments 9 also being situated between the lip 7 and the flange 8.

The lip 7 is festooned or crenellated and comprises solid portions alternating with empty portions. The flange 8 has holes 10, 26 that are regularly distributed all around its circumference.

The fan rotor is fitted with retention means for axially retaining the blades on the disk 1 in the upstream direction. These means comprise a ring 11 mounted in the annular groove 5 of the disk 1 and forming a bearing surface for the roots of the blades.

The ring 11 is festooned or crenellated in its inner periphery 12, having solid portions alternating with empty portions, and it has shapes that are substantially complementary to the shapes of the lip 7 so as to allow the ring 11 to the mounted and removed by being moved axially in translation.

The ring 11 includes an annular shoulder 13 at its outer periphery serving as a bearing surface for the spacers 36 so as to prevent the blade roots moving upstream.

Finally, the ring 11 includes an annular recess 14 that opens out upstream and in which the lip 7 of the disk 1 is received (FIG. 1).

The ring 11 is prevented from moving in rotation by means of a band 15 carrying axial teeth 16 that are inserted in the empty portions of the lip 7 of the disk 1 and of the ring 11. The upstream edge of the band 15 includes lugs 17 extending radially inwards, and formed with holes 18, 25 for passing bolts 19, 27. The band 15 is made of highly-alloyed steel so as to be capable of withstanding tear-out forces.

The ring 11 is thus prevented from moving in rotation by its solid portions coming into abutment against the teeth 16 of the band 15.

A cover 20, e.g. made of aluminum and conical in shape, is fastened on the disk 1. To do this, the middle portion of the cover 20 includes an inner annular lip 21 having through axial holes 22 formed therein (FIG. 2), which holes are situated facing some of the holes 18 in the band and some of the holes 10 in the flange 8 of the disk 1. The bolts 19 (FIG. 3) pass through these holes 22, 18, 10 and cooperate with nuts 23 enabling the cover 20, the band 15, and the disk 1 to be fastened together. The downstream portion 24 of the cover 20 covers the band 15 and the ring 11 so that the inner wall of the passage defined by the inter-blade platforms extends axially from the downstream portion 24 of the cover 20.

Figure 4:
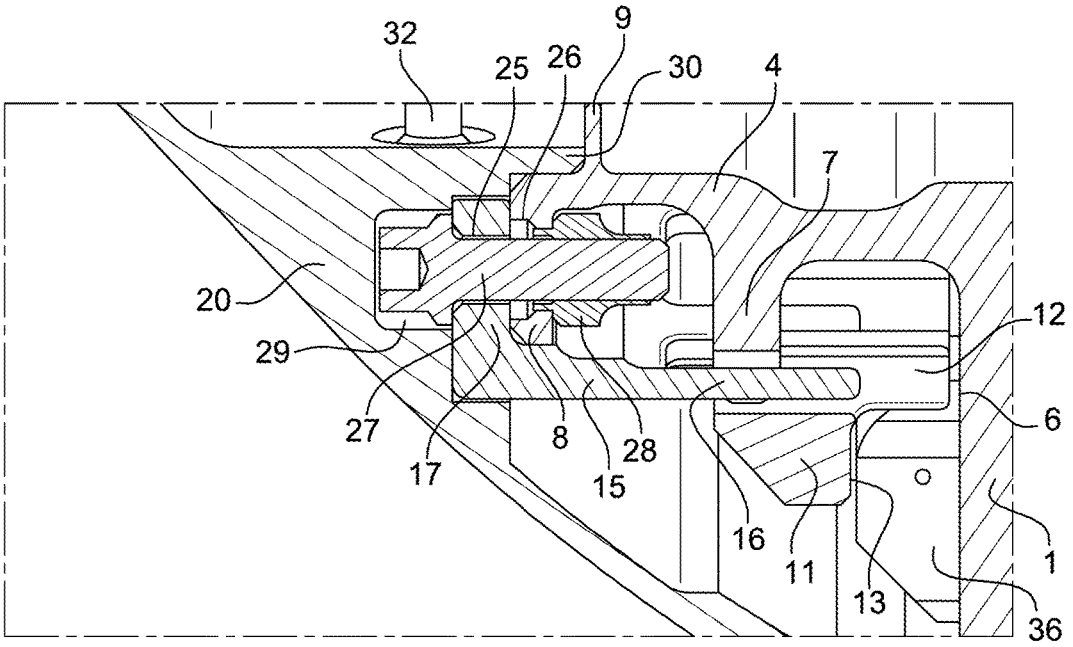
Fig. 4 PRIOR ART
FIG. 4 is a section view of a portion of the prior art fan rotor, showing a bolt for fastening the band to the disk.

As can be seen in FIG. 4, other holes 25 in the band 15, situated facing other holes 26 in the flange 8 of the disk 1 have bolts 27 passing therethrough and co-operating with nuts 28, serving solely for the purpose of fastening the band 15 to the disk 1. The heads of these bolts 27 are housed in blind holes 29 formed in the cover 20.

The cover 20 also has a cylindrical collar 30 extending upstream, with its end coming to bear against the abutments 9.

Figure 5:
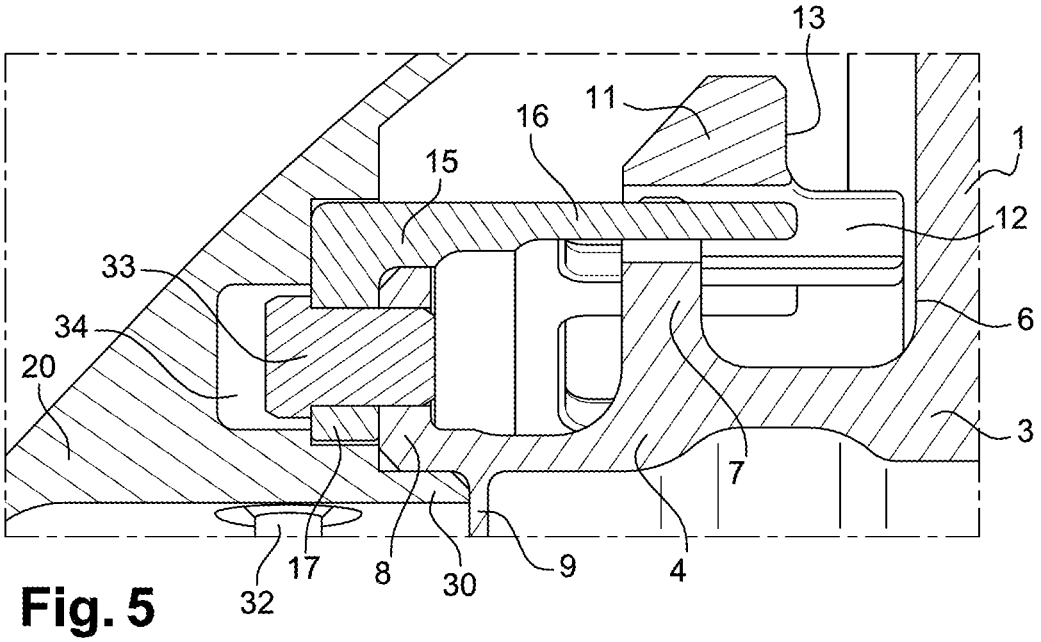
Fig. 5 PRIOR ART
FIG. 5 is a section view of a portion of the prior art fan rotor, showing an indexing peg.

The cover 20 also has radial threads 31 for mounting balance screws 32, as is well known in the prior art. In order to guarantee that the screws 32 are properly positioned, it is necessary to index the position of the cover relative to the fan rotor. To do this, and as shown in FIG. 5, an indexing peg 33 is mounted in the aligned holes of the band 15 and of the flange 8 of the disk 1. The peg 33 has a head housed in a blind hole 34 of the cover 20, with the diameter of the head of the peg 34 being determined so that it cannot be inserted in another blind hole 29 that is provided for receiving the heads of the bolts 27.

Figure 6:
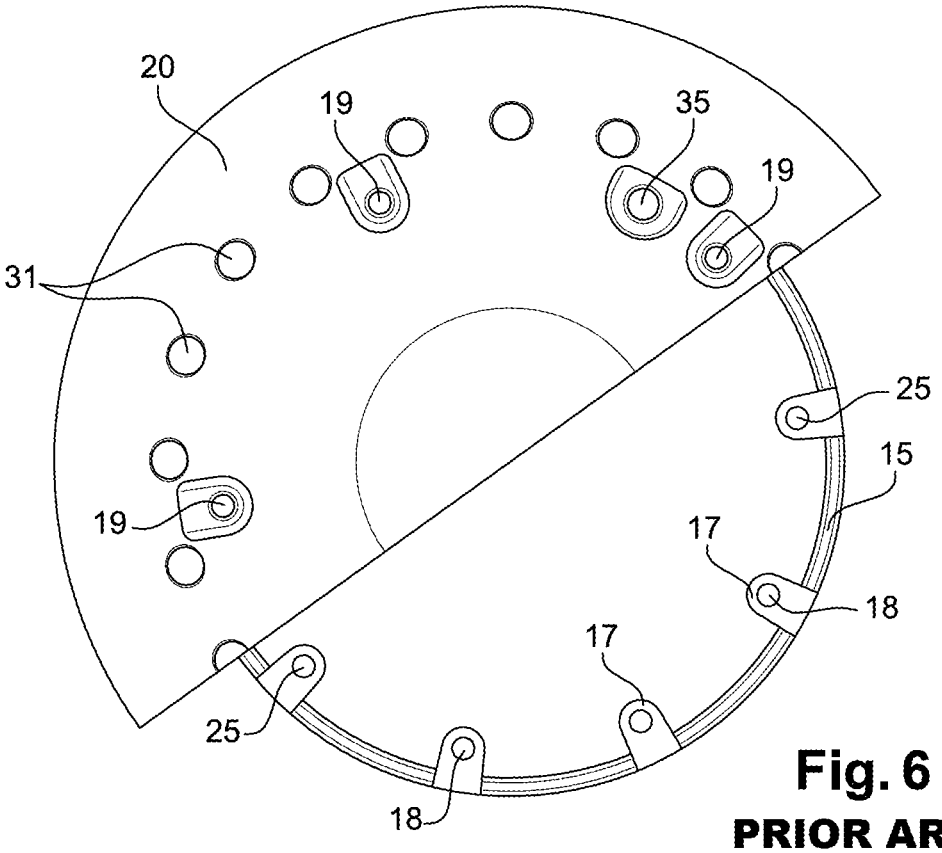
Fig. 6 PRIOR ART
FIG. 6 is a partially cut away front view of the cover, showing the band.
Figure 7:
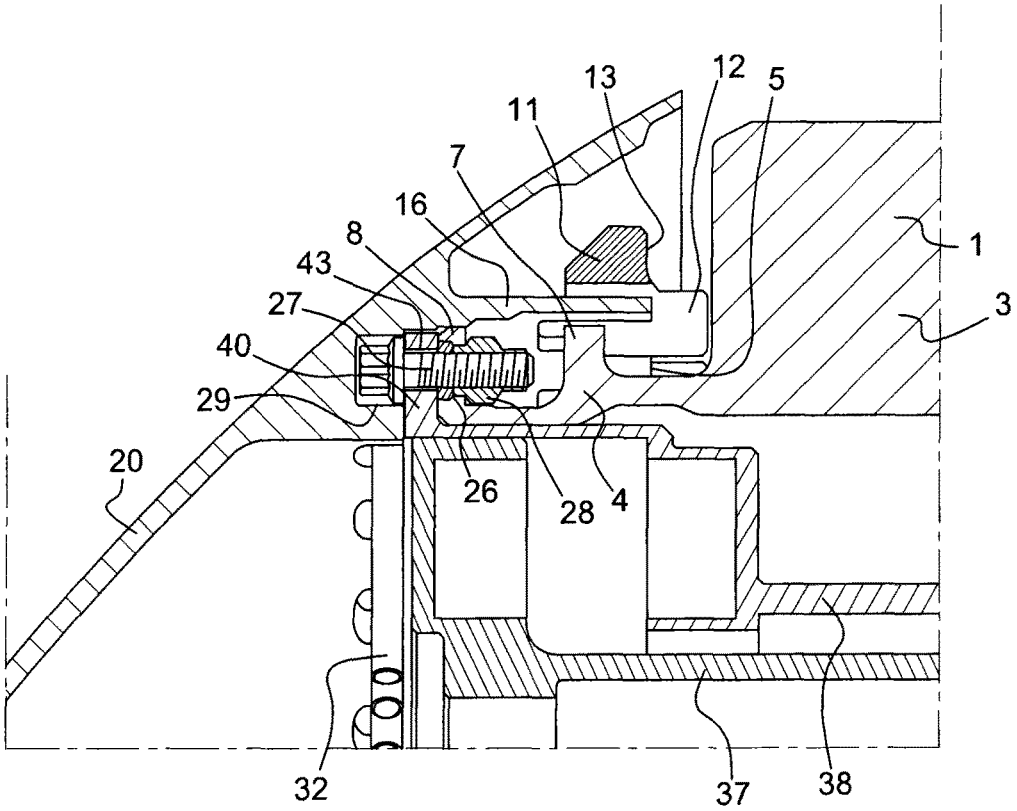
FIG. 7 is a view corresponding to FIG. 4 and showing a rotor in an embodiment of the invention.
Figure 8:
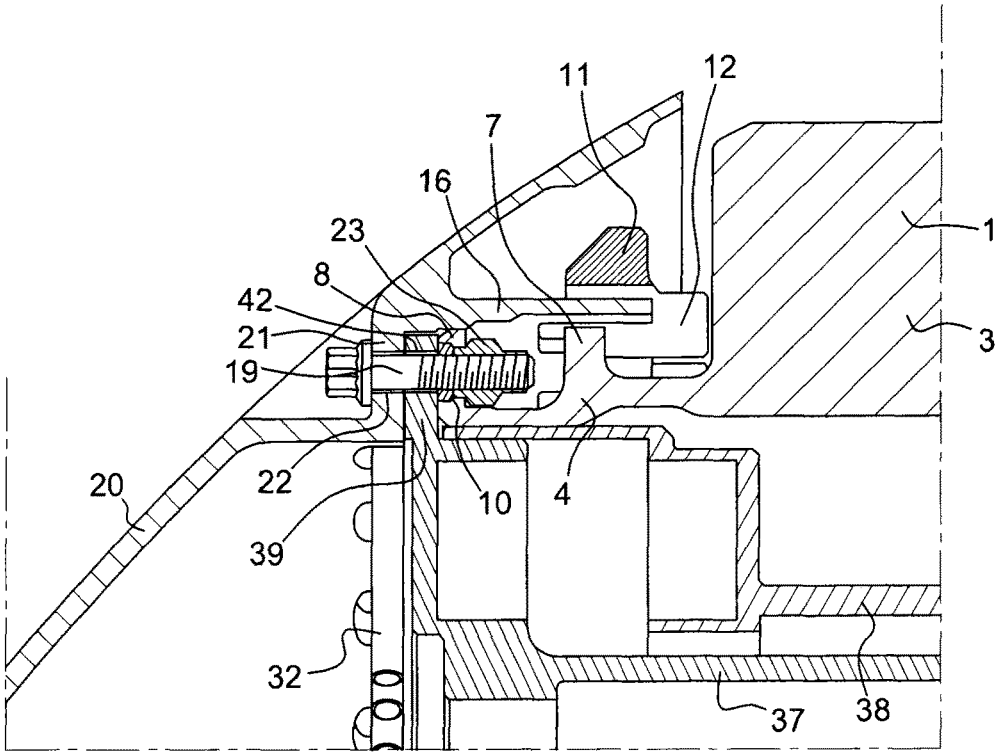
FIG. 8 is a view corresponding to FIG. 3 and showing said rotor of the invention.
Figure 9:
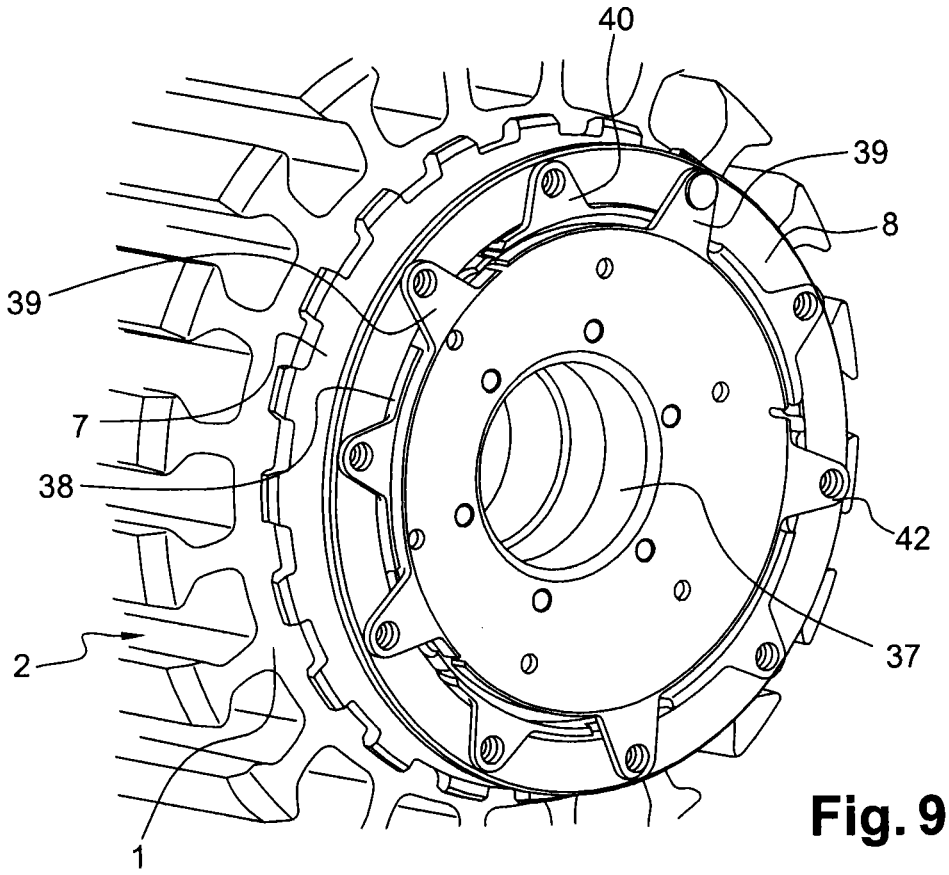
FIG. 9 is a perspective view of a portion of the rotor of the invention.
Figure 10:
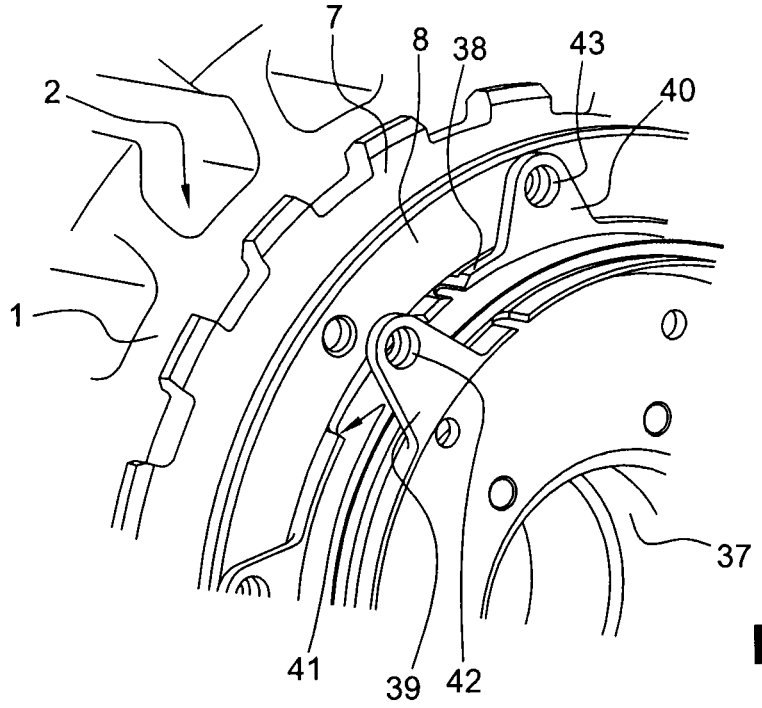
FIG. 10 is a detail view of a portion of FIG. 9.
Figure 11:
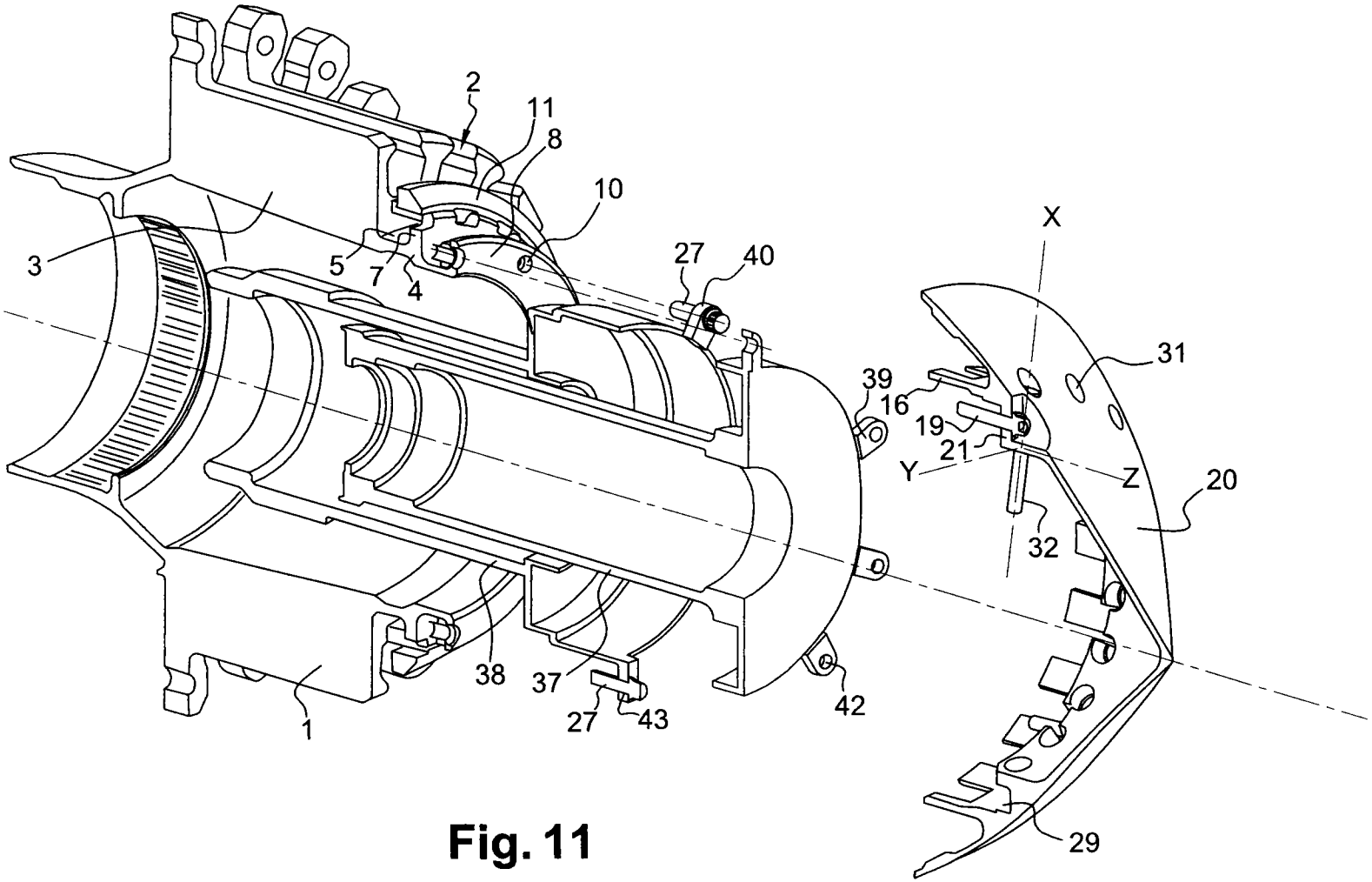
FIG. 11 is an exploded perspective view of the rotor of FIGS. 7 to 10.

The cover 20 also has two through tapped axial holes (FIG. 6) for passing screws 35 for extracting the cover 20 (FIG. 6).

As mentioned above, studies on the dynamic behavior of the engine have led to attempts to mount various parts of a telemeter within the rotor, and in particular inside the disk 1. The measurements taken with the help of the telemeter are constituted in particular by stress measurements or by temperature measurements in the disk 1 or the blades of the fan.

At least two of these parts, acting as supports, need to be capable of being fastened in simple and reliable manner to the rotor, which is impossible with the above described rotor structure, given the small amount of space available therein.

FIGS. 7 to 11 show a rotor in an embodiment of the invention, satisfying the above-mentioned problem.

As above, this rotor comprises a disk 1 carrying blades having roots engaged in substantially axial slots 2 in the outer periphery of the disk 1, a substantially frustoconical cover 20 mounted on the disk 1 upstream from the blades, and a ring 11 mounted in an annular groove 5 in the disk 1 and forming a bearing surface for the roots of the blades. The ring 11 is festooned or crenellated and co-operates with a festooned radial annular lip 7 of the annular groove 5 of the disk 1.

The rotor also has means for preventing the ring 11 from moving in rotation, which means are formed by axial teeth 16 extending from the inside wall of the cover 20. The teeth 16 are inserted in the hollow portions of the ring 11 and of the lip 7 of the disk 1.

The rotor also includes first and second coaxial parts 37 and 38, respectively an inner part and an outer part, that form supports for a telemetry system, for example. These parts 37 and 38 are arranged radially inside the disk 1 and they have respective first and second flanges 39 and 40 for fastening to the disk 1.

More particularly, the first part 37 has a plurality of first flanges 39 that are circumferentially offset from one another and situated in a common radial plane, and the second part 38 has a plurality of second flanges 40 that are circumferentially offset from one another and situated in the same radial plane as the first flanges 39, each second flange 40 being circumferentially interposed between two first flanges 39. At its upstream end, the second part 38 has notches 41 (FIG. 10) through which the flanges 39 of the first part 37 pass radially.

Each flange 39, 40 is formed by a lug extending radially outwards from the corresponding part 37, 38, and it includes a respective hole 42, 43.

The bolts 19 mounted in said holes 22 of the cover 20 also pass through the holes 42 in the flanges 39 of the first part 37 so as to fasten the first part 37 to the disk 1.

Also, the bolts 27 pass through the holes 43 in the flanges 40 of the second part 38 so as to fasten the second part 38 to the disk 1.

The invention thus makes it possible in simple and reliable manner to fasten both of the parts 37 and 38 to the disk 1 of the rotor, in spite of the space constraints in the rotor.

The number of parts for fastening to the disk may be greater than two. Under such circumstances, and as described above, the flanges of each part are offset circumferentially from one another and interposed circumferentially between the flanges of the other parts, with all of the flanges lying substantially in the same radial plane.

The invention claimed is:

1. A fan rotor for a turbine engine, the rotor comprising a disk carrying blades having roots engaged in substantially axial slots in the outer periphery of the disk, a substantially frustoconical cover mounted on the disk upstream from the blades, and axial retention mechanism for retaining the blades on the disk, said axial retention mechanism comprising a ring mounted in an annular groove in the disk and forming a bearing surface for the roots of the blades, the ring being festooned or crenellated and co-operating with a festooned radial annular lip of the annular groove in the disk, and a device for preventing the ring from moving in rotation, which device comprise at least one axial tooth engaged in hollow portions of the ring and of the lip of the disk, the rotor further comprising at least first and second coaxial parts arranged radially inside the disk and having respective first and second fastener flanges for fastening to the disk, said flanges being axially interposed between the cover and the disk, being circumferentially offset relative to one another, and said first and second flanges having holes for receiving independent fasteners.

2. The fan rotor according to claim 1, wherein the axial teeth are formed in the cover.

3. The rotor according to claim 1, wherein the first part has a plurality of first flanges that are circumferentially offset from one another and situated in a common radial plane, and the second part has a plurality of second flanges that are circumferentially offset from one another and situated in the same radial plane as the first flanges, each second flange being circumferentially interposed between two first flanges.

4. The rotor according to claim 1, wherein the first part is situated radially inside the second part, the second part including at least one notch having the flange of the first part passing radially therethrough.

5. The rotor according to claim 1, wherein the cover includes holes for fastening the cover to the disk via bolts mounted in said holes in the cover and also passing through the flanges of only one of the first and second parts, the flanges of the other one of said parts being fastened to the disk via other bolts.

6. The rotor according to claim 1, wherein the first and second flanges are formed by lugs extending radially outwards from the first and second parts.

7. The rotor according to claim 1, wherein the first and second parts belong to a telemetry system.

8. A turbine engine, comprising the rotor according to claim 1.

* * * * *